US009483975B2

(12) United States Patent
Marcu et al.

(10) Patent No.: US 9,483,975 B2
(45) Date of Patent: Nov. 1, 2016

(54) COLOR SPACE CONVERSION METHODS FOR ELECTRONIC DEVICE DISPLAYS

(71) Applicant: Apple Inc., Cupertino, CA (US)

(72) Inventors: Gabriel Marcu, San Jose, CA (US); Marc Albrecht, San Francisco, CA (US); Sandro H. Pintz, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 480 days.

(21) Appl. No.: 13/903,179

(22) Filed: May 28, 2013

(65) Prior Publication Data

US 2014/0354521 A1 Dec. 4, 2014

(51) Int. Cl.
*G09G 3/32* (2016.01)
*G09G 3/20* (2006.01)

(52) U.S. Cl.
CPC ..... *G09G 3/3208* (2013.01); *G09G 3/2003* (2013.01); *G09G 2300/0452* (2013.01); *G09G 2340/06* (2013.01)

(58) Field of Classification Search
CPC ..... G09G 5/02; G09G 2340/06
See application file for complete search history.

(56) References Cited

U.S. PATENT DOCUMENTS 5,533,173 A * 7/1996 Wober ..... G06T 11/001 358/1.15
5,592,591 A * 1/1997 Rolleston ..... H04N 1/60 358/1.5
5,625,378 A * 4/1997 Wan ..... H04N 1/6019 345/600
5,982,990 A * 11/1999 Gondek ..... H04N 1/6019 358/1.9
6,137,495 A * 10/2000 Gondek ..... G06T 11/001 345/600
6,771,275 B1 * 8/2004 Cook ..... H04N 1/6019 345/601
7,728,846 B2 6/2010 Higgins et al.
7,990,393 B2 8/2011 Higgins
8,035,655 B2 10/2011 Kim et al.
8,599,211 B2 * 12/2013 Hsieh ..... G09G 5/02 345/589
2009/0086094 A1 * 4/2009 Lee ..... G09G 3/2003 348/453
2009/0122075 A1 * 5/2009 Park ..... G09G 3/2003 345/602
2009/0244563 A1 * 10/2009 Nordback ..... G06F 3/13 358/1.9
2013/0106901 A1 * 5/2013 Inada ..... G09G 3/3406 345/600

(Continued)

OTHER PUBLICATIONS

Douglas A. Kerr, The CIE XYZ and xyY Color Space, Issue 1, Mar. 21, 2010.*

(Continued)

*Primary Examiner* — Kathy Wang-Hurst
*Assistant Examiner* — Peijie Shen
(74) *Attorney, Agent, or Firm* — Treyz Law Group, P.C.; Kendall P. Woodruff

(57) ABSTRACT

An electronic device may include a display having an array of display pixels. Storage and processing circuitry may generate display data for the display in an RGB input color space. The display may display the display data in an RGBW output color space. Display control circuitry may use sets of predetermined conversion factors to convert display data from the RGB input color space to the RGBW output color space without requiring conversion to a device-independent color space. Each set of predetermined conversion factors may be associated with a color in a set of predetermined colors. Using the sets of predetermined conversion factors, the display control circuitry may convert RGB values in the input color space to RGBW values in the output color space. The display control circuitry may supply data signals corresponding to the display data in the RGBW output color space to the array of display pixels.

14 Claims, 11 Drawing Sheets

(56) References Cited

U.S. PATENT DOCUMENTS

| | | | | |
|---|---|---|---|---|
| 2015/0138227 | A1* | 5/2015 | Zhao | H04N 5/57 345/601 |
| 2015/0154762 | A1* | 6/2015 | Yang | H04N 9/67 345/603 |

OTHER PUBLICATIONS

Brown Elliot et al., "Adding a White Subpixel," Clairvoyante, Inc. Cupertino, California, 2005 (6 pages).

Spindler et al., "System considerations for RGBW OLED displays," Eastman Kodak Co., Research and Development Labs, Rochester, New York, 2006 (12 pages).

* cited by examiner

COLOR SPACE CONVERSION METHODS FOR ELECTRONIC DEVICE DISPLAYS

BACKGROUND

This relates generally to electronic devices with displays and, more particularly, to electronic devices with displays having efficient methods of converting from an input color space such as a red-green-blue (RGB) color space to an output color space such as a red-green-blue-white (RGBW) color space.

Electronic devices such as computers, media players, cellular telephones, set-top boxes, and other electronic equipment are often provided with displays for displaying visual information.

Displays such as organic light-emitting diode (OLED) displays and liquid crystal displays typically include an array of display pixels. Each display pixel may include one or more colored subpixels for displaying color images. In some types of displays, each display pixel includes a red subpixel, a green subpixel, a blue subpixel, and a white subpixel. These types of displays are sometimes referred to as RGBW displays.

Electronic devices having displays typically generate pixel values for the display in an RGB color space. Electronic devices having RGBW displays are therefore required to convert the pixel values from an RGB input color space to an RGBW output color space.

In conventional electronic devices, converting display data from an RGB input color space to an RGBW output color space is achieved by first transforming RGB pixel values in the RGB color space to XYZ tristimulus values in a device-independent color space. The XYZ tristimulus values in the device-independent color space are then transformed into RGBW pixel values in an RGBW color space.

The mathematical operations involved in transforming XYZ tristimulus values to RGBW pixel values can be complicated and performing such operations on-the-fly can be undesirably inefficient. The operations may involve equations that have no solution or that have multiple solutions. Additional gamut mapping may be required to obtain RGBW pixel values that produce the desired color on the display.

It would therefore be desirable to be able to provide improved ways of displaying images on displays such as RGBW displays.

SUMMARY

An electronic device may include a display having an array of display pixels. The electronic device may include storage and processing circuitry that generates display data for the display. The input color space in which display data is generated for the display may be different from the output color space in which display data is displayed on the display.

For example, the storage and processing circuitry may generate display data in an RGB input color space, whereas the display may be an RGBW display that renders colors in an RGBW output color space.

Display control circuitry may use sets of predetermined conversion factors to convert display data from the RGB input color space to the RGBW output color space without requiring conversion to an intermediate, device-independent color space. Each set of predetermined conversion factors may be associated with a color in a set of predetermined colors.

The display control circuitry may receive a red value, a green value, and a blue value that together correspond to a desired color in the input color space. The display control circuitry may then compare the color associated with the red, green, and blue values with each of the predetermined colors. Based on the comparison, the display control circuitry may determine a set of conversion factors for the color. If the color matches one of the predetermined colors, the set of predetermined conversion factors associated with that color may be used. If the color does not exactly match any of the predetermined colors, then a set of conversion factors may be interpolated based on the sets of predetermined conversion factors.

The display control circuitry may then determine a red pixel value, a green pixel value, a blue pixel value, and a white pixel value using the set of conversion factors. The red, green, blue, and white pixel values may together correspond to the desired color in the RGBW output color space. The display control circuitry may provide data signals corresponding to the red, green, blue, and white pixel values to a display pixel so that the display pixel displays the desired color.

The array of display pixels may be an array of red, green, blue, and white OLED pixels. The red, green, and blue OLED pixels may each include a white OLED emitter and a color filter element formed over the white OLED emitter. The white OLED pixels may each include an unfiltered white OLED emitter.

Further features of the invention, its nature and various advantages will be more apparent from the accompanying drawings and the following detailed description of the preferred embodiments.

DETAILED DESCRIPTION

Figure 1:
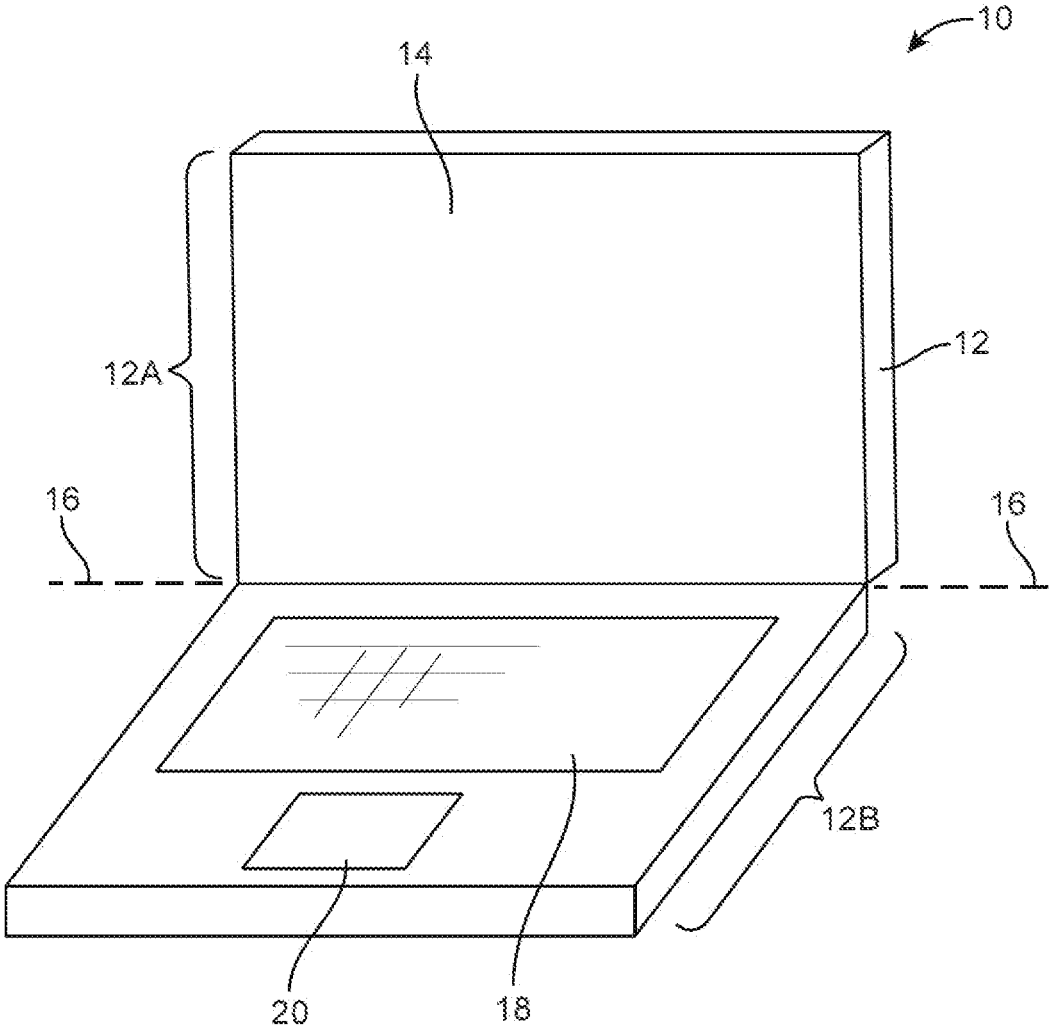
FIG. 1 is a perspective view of an illustrative electronic device such as a portable computer having a display in accordance with an embodiment of the present invention.

Electronic devices such as cellular telephones, media players, computers, set-top boxes, wireless access points, and other electronic equipment may include displays. Displays may be used to present visual information and status data and/or may be used to gather user input data.

A display may include an array of display pixels. Each display pixel may include one or more colored subpixels for displaying color images. For example, each display pixel may include a red subpixel, a green subpixel, a blue subpixel, and a white subpixel. During display operations, each display pixel may receive a red subpixel value, a green subpixel value, a blue subpixel value, and a white subpixel value that together define the color to be created by that pixel. These red, green, blue, and white values are sometimes referred to herein in the aggregate as "RGBW values," as understood to those of ordinary skill in the art.

An electronic device having a display may include storage and processing circuitry and display control circuitry for controlling operation of the display. The storage and processing circuitry may generate display data for the display. The color space in which display data is generated may sometimes be referred to herein as the "input color space." The display control circuitry may receive the display data from the storage and processing circuitry and may provide corresponding pixel values to the display. The color space in which colors are rendered on a display is sometimes referred to herein as the "output color space" or the "target color space."

In some electronic devices, the input color space in which display data is generated may be different from the output color space in which display data is displayed. For example, storage and processing circuitry may generate display data in an RGB input color space, whereas the display may render colors in an RGBW output color space.

Display control circuitry may be used to convert incoming display data from an RGB input color space to an RGBW output color space. For example, the display control circuitry may convert incoming red, green, and blue pixel values (sometimes referred to herein in the aggregate as RGB values or subpixel color values) corresponding to a given color into RGBW values that will render that color on the display.

In conventional devices, RGB pixel values are converted into RGBW pixel values through a series of complex mathematical operations. These mathematical operations typically include converting RGB pixel values in an input color space to XYZ tristimulus values in a device-independent color space, and subsequently converting the XYZ tristimulus values in the device-independent color space to RGBW pixel values in an output color space. This type of RGB-to-RGBW conversion method can be complex and performing such mathematical operations on-the-fly can be undesirably inefficient.

An electronic device may efficiently convert display data from an input color space to an output color space using stored (i.e., predetermined) conversion factors. For example, the display control circuitry may use stored conversion factors to convert display data from an input color space to an output color space without requiring conversion to an intermediary color space such as a device-independent color space.

An illustrative electronic device of the type that may be provided with a display that uses stored conversion factors for efficient conversion from an input color space to an output color space is shown in FIG. 1. Electronic device 10 may be a computer such as a computer that is integrated into a display such as a computer monitor, a laptop computer, a tablet computer, a somewhat smaller portable device such as a wrist-watch device, pendant device, or other wearable or miniature device, a cellular telephone, a media player, a tablet computer, a gaming device, a navigation device, a computer monitor, a television, or other electronic equipment.

As shown in FIG. 1, device 10 may include a display such as display 14. Display 14 may be a touch screen that incorporates capacitive touch electrodes or other touch sensor components or may be a display that is not touch-sensitive. Display 14 may include image pixels formed from light-emitting diodes (LEDs), organic light-emitting diodes (OLEDs), plasma cells, electrophoretic display elements, electrowetting display elements, liquid crystal display (LCD) components, or other suitable image pixel structures. Arrangements in which display 14 is formed using organic light-emitting diode pixels are sometimes described herein as an example. This is, however, merely illustrative. Any suitable type of display technology may be used in forming display 14 if desired.

Device 10 may have a housing such as housing 12. Housing 12, which may sometimes be referred to as a case, may be formed of plastic, glass, ceramics, fiber composites, metal (e.g., stainless steel, aluminum, etc.), other suitable materials, or a combination of any two or more of these materials.

Housing 12 may be formed using a unibody configuration in which some or all of housing 12 is machined or molded as a single structure or may be formed using multiple structures (e.g., an internal frame structure, one or more structures that form exterior housing surfaces, etc.).

As shown in FIG. 1, housing 12 may have multiple parts. For example, housing 12 may have upper portion 12A and lower portion 12B. Upper portion 12A may be coupled to lower portion 12B using a hinge that allows portion 12A to rotate about rotational axis 16 relative to portion 12B. A keyboard such as keyboard 18 and a touch pad such as touch pad 20 may be mounted in housing portion 12B.

Figure 2:
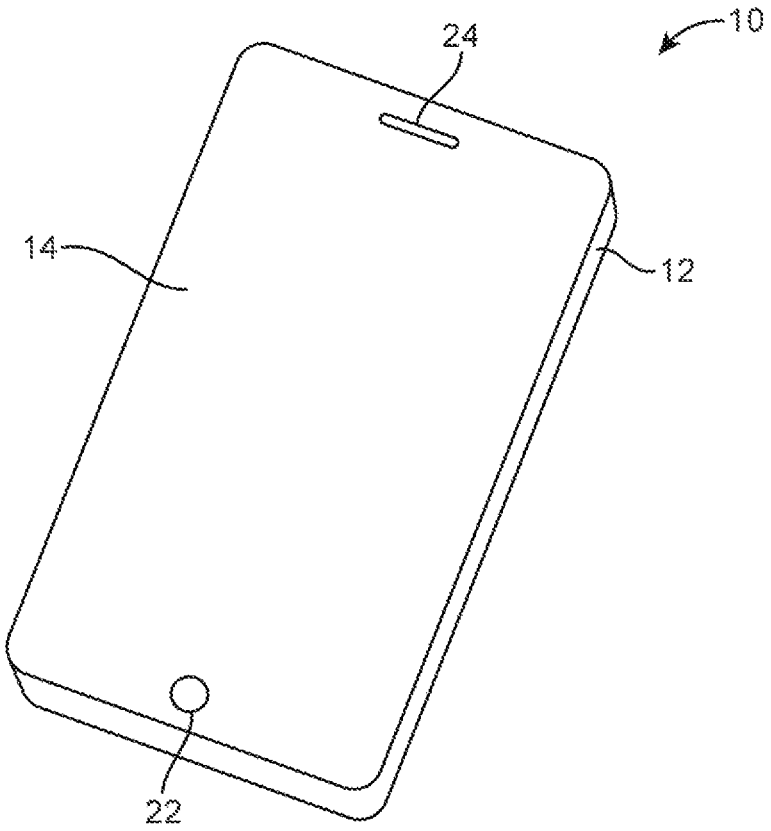
FIG. 2 is a perspective view of an illustrative electronic device such as a cellular telephone or other handheld device having a display in accordance with an embodiment of the present invention.

In the example of FIG. 2, device 10 has been implemented using a housing that is sufficiently small to fit within a user's hand (e.g., device 10 of FIG. 2 may be a handheld electronic device such as a cellular telephone). As show in FIG. 2, device 10 may include a display such as display 14 mounted on the front of housing 12. Display 14 may be substantially filled with active display pixels or may have an active portion and an inactive portion. Display 14 may have openings (e.g., openings in the inactive or active portions of display 14) such as an opening to accommodate button 22 and an opening to accommodate speaker port 24.

Figure 3:
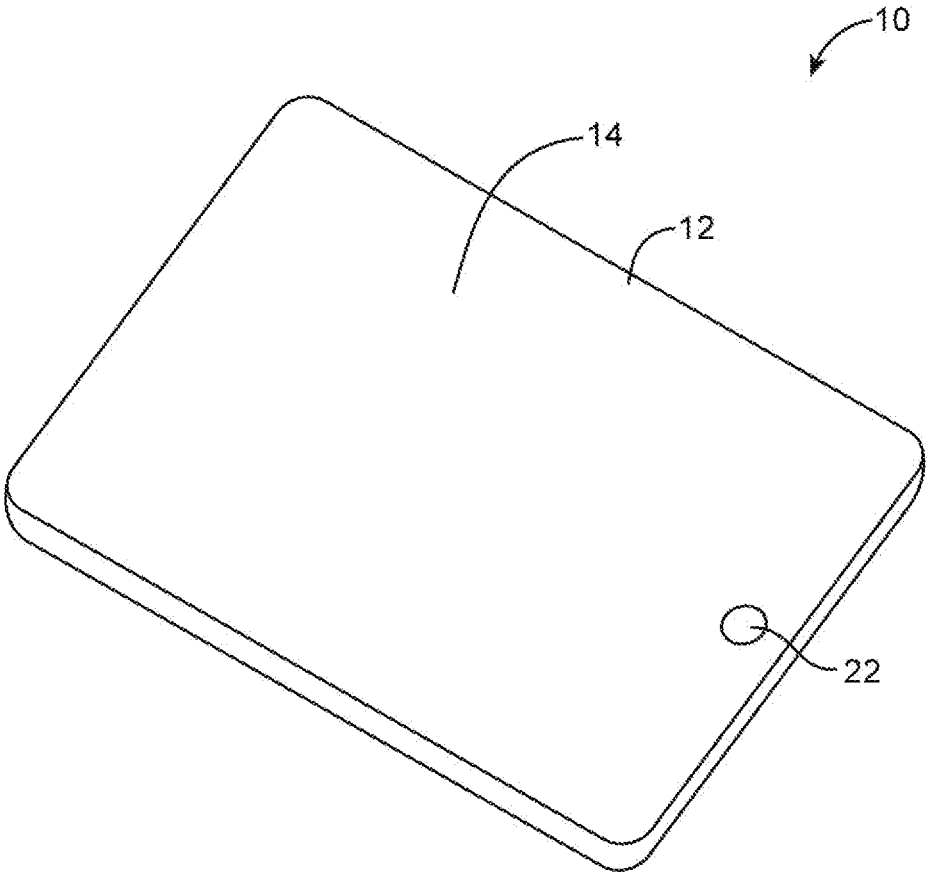
FIG. 3 is a perspective view of an illustrative electronic device such as a tablet computer having a display in accordance with an embodiment of the present invention.

FIG. 3 is a perspective view of electronic device 10 in a configuration in which electronic device 10 has been implemented in the form of a tablet computer. As shown in FIG. 3, display 14 may be mounted on the upper (front) surface of housing 12. An opening may be formed in display 14 to accommodate button 22.

Figure 4:
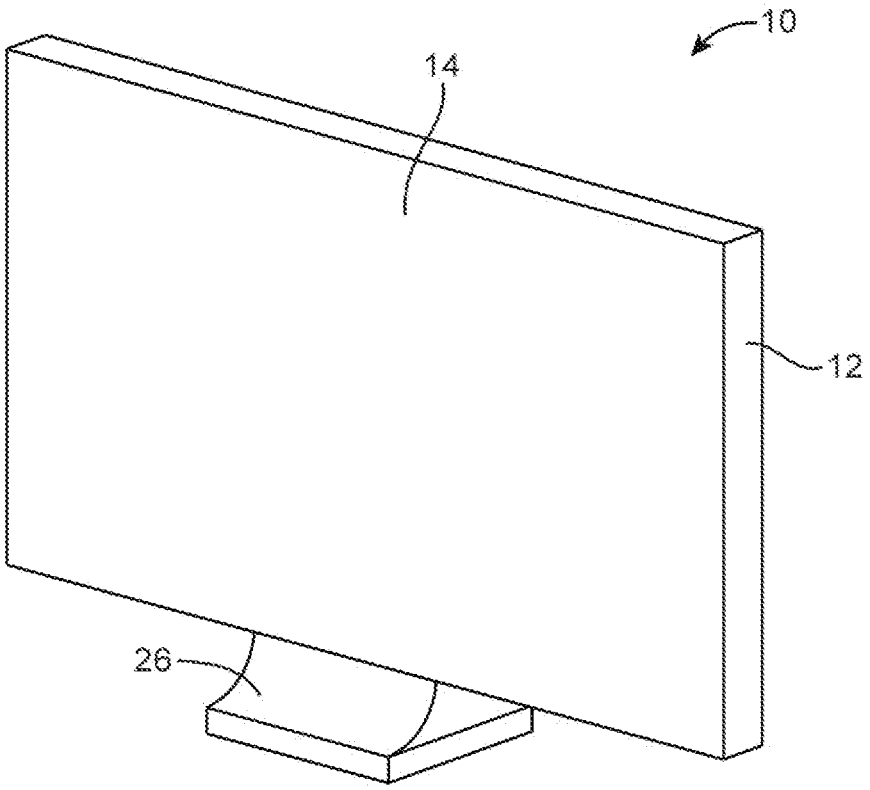
FIG. 4 is a perspective view of an illustrative electronic device such as a computer monitor with a built-in computer having a display in accordance with an embodiment of the present invention.

FIG. 4 is a perspective view of electronic device 10 in a configuration in which electronic device 10 has been implemented in the form of a computer integrated into a computer monitor. As shown in FIG. 4, display 14 may be mounted on a front surface of housing 12. Stand 26 may be used to support housing 12.

Figure 5:
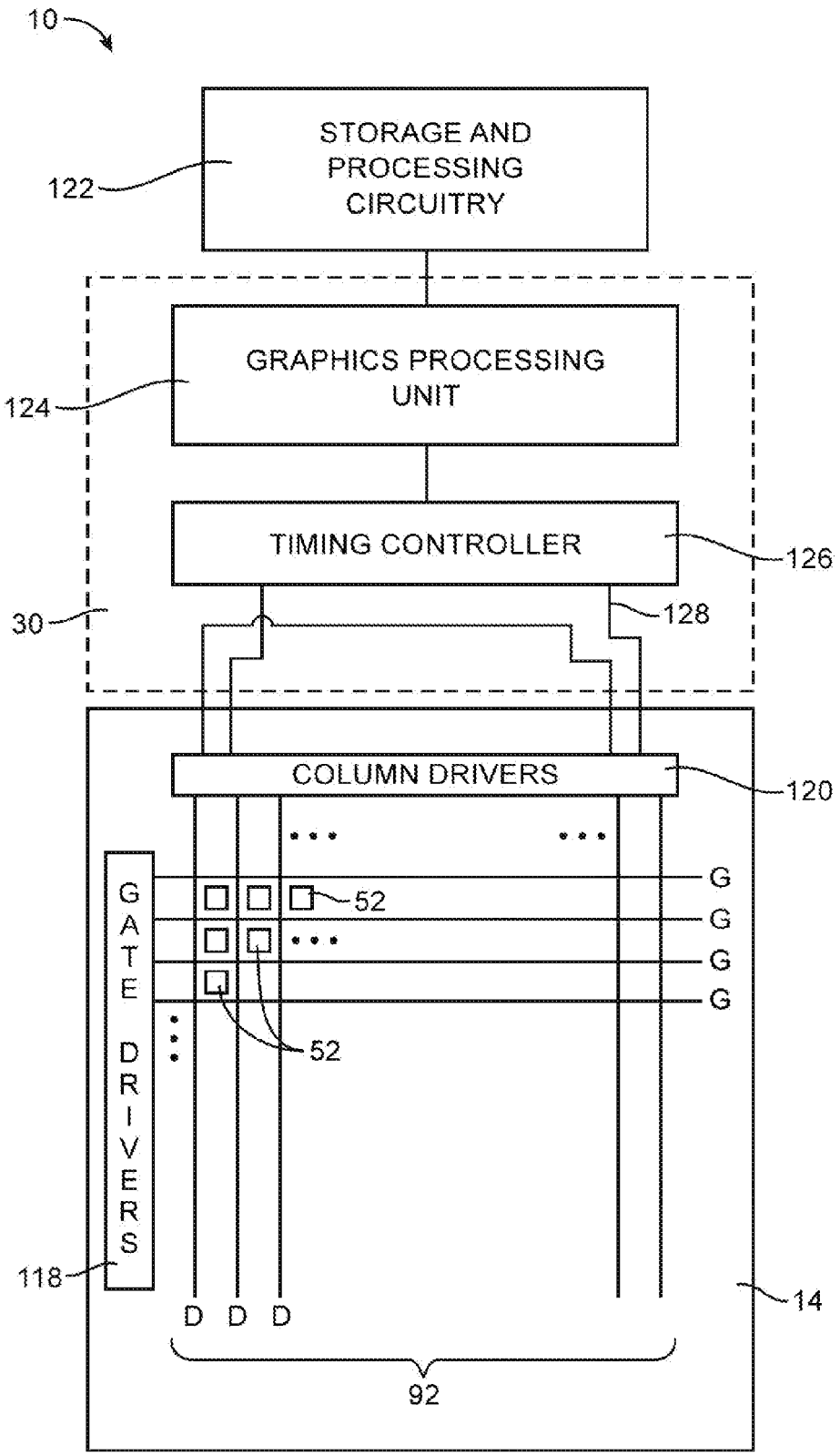
FIG. 5 is a schematic diagram of an illustrative electronic device having a display in accordance with an embodiment of the present invention.

FIG. 5 is a diagram of device 10 showing illustrative circuitry that may be used in displaying images for a user of device 10 on pixel array 92 of display 14. As shown in FIG. 5, display 14 may have column driver circuitry 120 that drives data signals (analog voltages) onto the data lines D of array 92. Gate driver circuitry 118 drives gate line signals onto gate lines G of array 92. Using the data lines and gate lines, display pixels 52 may be configured to display images on display 14 for a user. Gate driver circuitry 118 may be implemented using thin-film transistor circuitry on a display substrate such as a glass or plastic display substrate or may be implemented using integrated circuits that are mounted on the display substrate or attached to the display substrate by a flexible printed circuit or other connecting layer. Column driver circuitry 120 may be implemented using one or more column driver integrated circuits that are mounted on the display substrate or using column driver circuits mounted on other substrates.

Device 10 may include storage and processing circuitry 122. Storage and processing circuitry 122 may include one or more different types of storage such as hard disk drive storage, nonvolatile memory (e.g., flash memory or other electrically-programmable-read-only memory), volatile memory (e.g., static or dynamic random-access-memory), etc. Processing circuitry in storage and processing circuitry 122 may be used in controlling the operation of device 10. The processing circuitry may be based on a processor such as a microprocessor and other suitable integrated circuits. With one suitable arrangement, storage and processing circuitry 122 may be used to run software on device 10, such as internet browsing applications, email applications, media playback applications, operating system functions, software for capturing and processing images, software implementing functions associated with gathering and processing sensor data, software that makes adjustments to display brightness and touch sensor functionality, etc.

During operation of device 10, storage and processing circuitry 122 may produce data that is to be displayed on display 14. This display data may be provided to display control circuitry such as timing controller integrated circuit 126 using graphics processing unit 124.

Timing controller 126 may provide digital display data to column driver circuitry 120 using paths 128. Column driver circuitry 120 may receive the digital display data from timing controller 126. Using digital-to-analog converter circuitry within column driver circuitry 120, column driver circuitry 120 may provide corresponding analog output signals on the data lines D running along the columns of display pixels 52 of array 92.

Graphics processing unit 124 and timing controller 126 may sometimes collectively be referred to herein as display control circuitry 30. Display control circuitry 30 may be used in controlling the operation of display 14. For example, display control circuitry 30 may use stored conversion factors to convert incoming frames of display data from an input color space (e.g., an RGB color space) to an output color space (e.g., an RGBW color space). Display control circuitry 30 may supply data signals corresponding to the frames of display data in the output color space to display pixel array 92.

Figure 6:
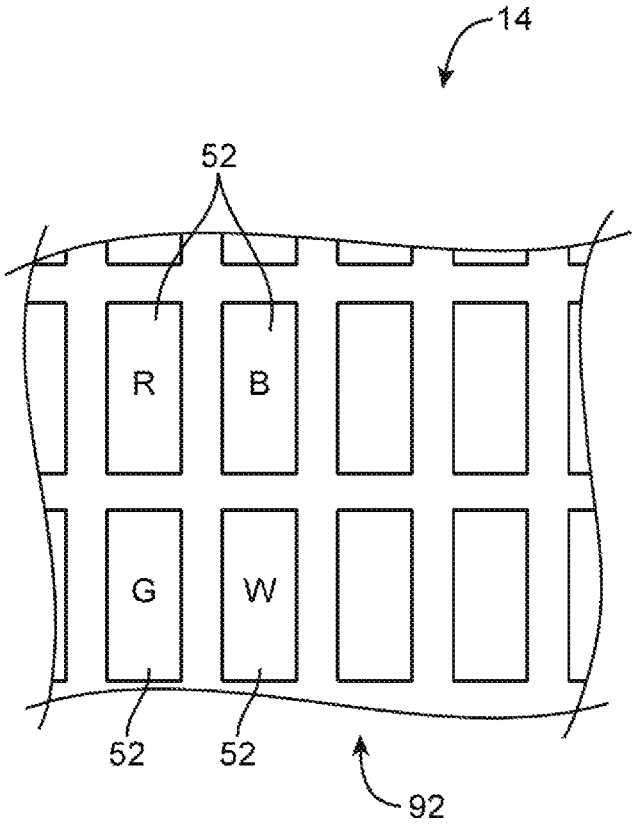
FIG. 6 is a diagram of a portion of an illustrative display showing how colored display pixels may be arranged in rows and columns in accordance with an embodiment of the present invention.

A portion of an illustrative array of display pixels that may be used in display 14 is shown in FIG. 6. As shown in FIG. 6, display 14 may have a pixel array such as pixel array 92 with rows and columns of pixels such as display pixels 52. There may be tens, hundreds, or thousands of rows and columns of display pixels 52. Each pixel 52 may, if desired, be a color pixel such as a red pixel (R), a green pixel (G), a blue pixel (B), a white pixel (W), or a pixel of another color.

In some arrangements, each colored subpixel 52 may be formed from colored OLED material (i.e., OLED material that emits light of a given color). With this type of configuration, red pixels may be formed from red OLED material (sometimes referred to as a red "emitter"), green pixels may be formed from green OLED material (sometimes referred to as a green "emitter"), and blue pixels may be formed from blue OLED material (sometimes referred to as a blue "emitter").

In other arrangements, each colored subpixel 52 may be formed by covering white OLED material (sometimes referred to as a white "emitter") with color filter material. For example, pixel array 92 may be formed by covering an array of white OLED emitters with an array of red, green, and blue color filter elements (sometimes referred to as an RGB color filter array). White pixels may be formed from an unfiltered white emitter (i.e., white pixels may be formed from white OLED material that is not covered with color filter material).

This is, however, merely illustrative. If desired, colored pixels may be formed from other suitable types of pixel structures such as liquid crystal pixel elements that are covered with color filter material. Arrangements in which pixel array 92 is formed from an RGB color filter array formed over an array of white OLED emitters are sometimes described herein as an illustrative example.

Pixels 52 may include pixels of any suitable color. For example, pixels 52 may include a pattern of cyan, magenta, and yellow pixels, or may include any other suitable pattern of colors. Arrangements in which pixels 52 include a pattern of red, green, blue, and white pixels are sometimes described herein as an example.

It should also be understood that the arrangement of colors shown in FIG. 6 is merely illustrative. Colored subpixels may be arranged in any suitable pattern (e.g., RGBW quad pattern, RGBW eight-subpixel repeat cell pattern, RGBW six-subpixel repeat cell pattern, other suitable patterns, etc.).

Display control circuitry 30 (FIG. 5) may receive incoming display data from storage and processing circuitry 122. The input color space in which storage and processing circuitry generates display data may be different from the output color space in which the display data is displayed on display 14. Display control circuitry may therefore convert incoming display data from the input color space to the output color space so that colors are accurately rendered on display 14.

Figure 7:
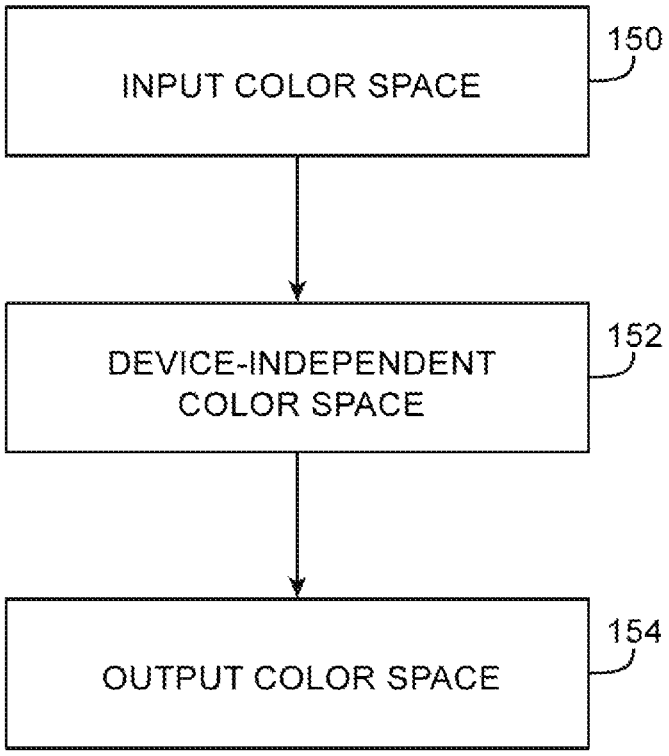
(PRIOR ART) FIG. 7
FIG. 7 is a diagram illustrating how conventional electronic devices convert display data from an input color space to an output color space by converting the display data to an intermediate, device-independent color space.

A diagram illustrating conventional methods of converting display data from an input color space to an output color space are shown in FIG. 7. As shown in FIG. 7, display data is typically converted from an input color space 150 to an output color space 154 by first converting the display data to a device-independent color space 152. For example, a conventional electronic device having an RGBW display may generate display data in an RGB input color space 150. To convert RGB values into corresponding RGBW values, the RGB values in the RGB input color space 150 are first converted into XYZ tristimulus values in device-independent color space 152. The XYZ tristimulus values in device-independent color space 152 are then converted into RGBW values in the RGBW output color space 154.

The mathematical operations involved in transforming the XYZ tristimulus values to RGBW pixel values can be complicated and it can therefore be undesirably inefficient to perform such operations on-the-fly (i.e., during operation of an electronic device). The operations may involve equations that have no solution or that have multiple solutions. Additional gamut mapping may be required to obtain RGBW pixel values that produce the desired color on the display.

Figure 8:
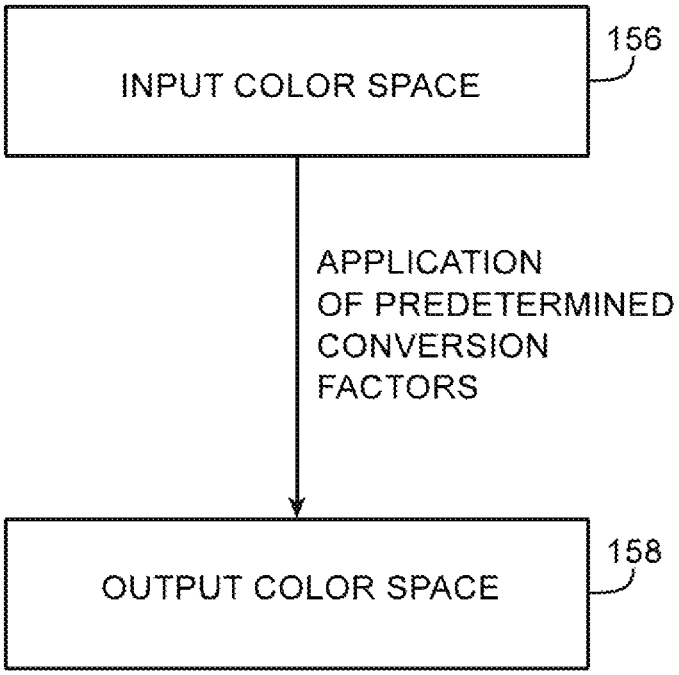
FIG. 8 is a diagram illustrating how an electronic device may use predetermined conversion factors to efficiently convert display data from an input color space to an output color space without requiring conversion to an intermediate, device-independent color space in accordance with an embodiment of the present invention.

A diagram illustrating a method of efficiently converting display data from an input color space to an output color space on-the-fly is shown in FIG. 8. As shown in FIG. 8, display data may be converted from input color space 156 to output color space 158 without requiring conversion to an intermediary color space such as a device-independent color space. Display control circuitry may use predetermined conversion factors to convert display data from input color space 156 to output color space 158.

Input color space 156 may, for example, be an RGB color space (e.g., sRGB, Adobe RGB 1998, other suitable RGB color space), CMYK color space, or other suitable color space. Output color space 158 may be an RGBW color space, an RGB color space, or other suitable color space. Configurations in which input color space 156 is an RGB input color space and in which output color space 158 is an RGBW output color space are sometimes described herein as an illustrative example. However, it should be appreciated that predetermined conversion factors may be used to efficiently convert display data from any suitable input color space to any suitable output color space.

The predetermined conversion factors may be stored in electronic device 10 (e.g., in storage and processing circuitry 122, in display control circuitry 30, or in any other suitable location in electronic device 10). Each conversion factor may be associated with a specific color within a color space (e.g., within the input color space). For example, each color in a predetermined set of colors may have an associated set of predetermined conversion factors (e.g., a red conversion factor, a green conversion factor, a blue conversion factor, and a white conversion factor).

Figure 9:
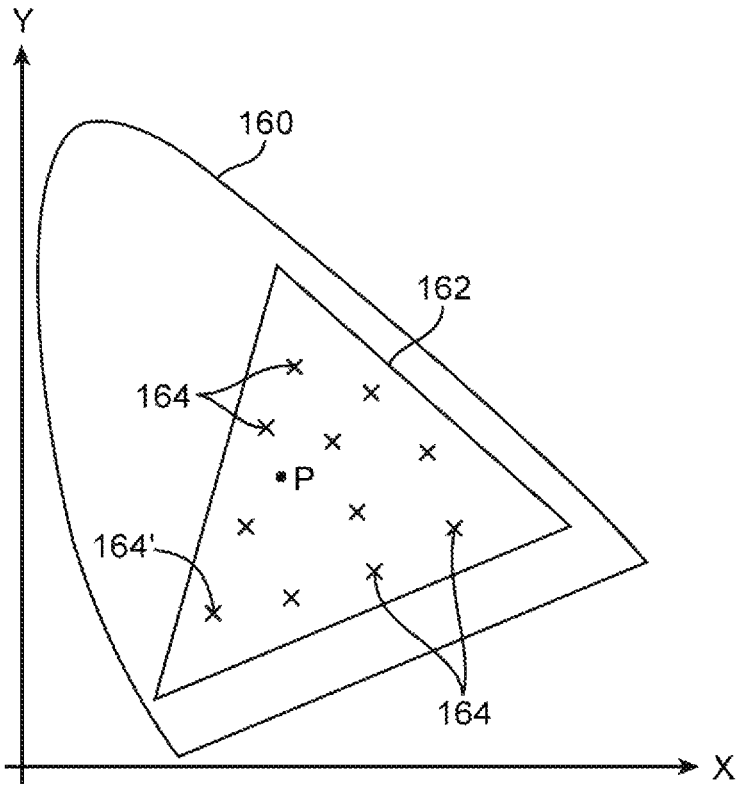
FIG. 9 is a chromaticity diagram showing a set of colors that may have associated sets of predetermined conversion factors for converting display data from an input color space to an output color space in accordance with an embodiment of the present invention.

FIG. 9 is a chromaticity diagram illustrating a two-dimensional projection of a three-dimensional color space. The color generated by a display such as display 14 may be represented by chromaticity values x and y. Chromaticity values may be computed by transforming, for example, three color intensity values such as red, green, and blue intensity values into three tristimulus values X, Y, and Z and subsequently normalizing the first two tristimulus values X and Y (e.g., by computing x=X/(X+Y+Z) and y=Y/(X+Y+Z) to obtain x and y chromaticity values. Transforming color intensities into tristimulus values may be performed using transformations defined by the International Commission on Illumination (CIE) or using any other suitable color transformation for computing tristimulus values.

Any color generated by a display may therefore be represented by a point (e.g., by chromaticity values x and y) on a chromaticity diagram such as the diagram shown in FIG. 9. Bounded region 160 of FIG. 9 represents the limits of visible light that may be perceived by humans (i.e., the total available color space). This color space is sometimes referred to as the CIE 1931 color space. The colors that may be generated by an electronic device are contained within a subregion of bounded region 160. For example, bounded region 162 may represent the color gamut of an RGB color space.

During manufacturing, a set of conversion factors may be calculated for each color in a set of colors. For example, each point 164 in color space 162 may correspond to a color in color space 162 for which conversion factors are calculated during manufacturing. Each point 164 (i.e., each color 164) may therefore have an associated set of conversion factors. The set of conversion factors associated with a given color 164 in color space 162 (e.g., in RGB input color space 162) may be used to produce that color 164 in a different color space (e.g., in an RGBW output color space).

Consider, for example, color 164' in RGB color space 162. In RGB color space 162, color 164' may have RGB values of R=100; G=50; and B=200 (as an example). In a different color space such as an RGBW output color space, color 164' may be rendered using RGBW values of R'=43; G'=0; B'=56; and W'=47. A "set" of conversion factors fR, fG, fB, fW for color 164' would then be calculated using the following equations:

$$R'=fR*\mathrm{val(RGB)}$$

$$G'=fG*\mathrm{val(RGB)}$$

$$B'=fB*\mathrm{val(RGB)}$$

$$W'=fW*\mathrm{val(RGB)} \quad (1)$$

where val(RGB) is a value determined based on the RGB values associated with color 164' in color space 162. For example, val(RGB) may be the minimum value of the RGB values associated with color 164', may be the maximum value of the RGB values associated with color 164', may be a fraction of the maximum value of the RGB values associated with color 164', or may be any other suitable value determined based on the RGB values associated with color 164' in color space 162. For this illustrative example, if val(RGB) is set to the minimum value of the RGB values, then val(RGB)=50 and the conversion factors would be fR=0.86; fG=0; fB=1.12; and fW=0.94.

A set of conversion factors may be calculated for each color 164' in color space 162. A set of conversion factors may be calculated for any suitable number of colors (e.g., 2, 5, 10, 15, more than 15, or less than 15 colors). The sets of conversion factors may be stored in electronic device 10.

The RGBW values that render each color 164 in the RGBW color space may be calculated using any suitable conversion technique. For example, as described in connection with prior art conversion methods, the RGBW values that correspond to a given color 164 may be determined by first transforming the RGB values associated with that color in the RGB color space into XYZ tristimulus values and subsequently transforming the XYZ tristimulus values into RGBW values that render that color in the RGBW color space. If desired, other RGB-to-RGBW conversion techniques may be used.

By doing such calculations offline (e.g., during manufacturing), the computing power required to convert display data from an input color space to an output color space on-the-fly (i.e., during operation of electronic device 10) may be significantly reduced. Using the stored sets of conversion factors, display control circuitry 30 may efficiently convert incoming display data from an RGB input color space to an RGBW output color space, without requiring on-the-fly conversion to an intermediary, device-independent color space.

For example, display control circuitry 30 may receive a red value R, a green value G, and a blue value B from storage and processing circuitry 122. The red, green, and blue values may together correspond to a color to be displayed by a display pixel in display 14. The red, green, and blue values may, for example, correspond to point P in RGB input color space 162. Point P may correspond to a color that does not exactly match any of the colors 164 for which conversion factors have been stored. A set of conversion factors for point P may therefore be interpolated using nearby colors 164 (e.g., using inverse distance weighting, Delaunay triangulation, bilinear interpolation, tetrahedral interpolation, other suitable interpolation techniques, a combination of these interpolation techniques, etc.). In the case where incoming display data includes a color for which conversion factors have been stored, interpolation may not be required.

The interpolated set of conversion factors fR', fG', fB', and RW' may then be used to determine RGBW values that will render color P in the RGBW color space. For example, the following equations may be used to determine RGBW values R', G', B', and W' for point P:

$$R'=fR'*\mathrm{val(RGB)}$$

$$G'=fG'*\mathrm{val(RGB)}$$

$$B'=fB'*\mathrm{val(RGB)}$$

$$W'=fW'*\mathrm{val(RGB)} \quad (2)$$

where val(RGB) is a value determined based on the red, green, and blue values associated with color P in RGB input color space 162. For example, val(RGB) may be the minimum value of the red, green, and blue values associated with color P; may be the maximum value of the red, green, and blue values associated with color P; may be a value between the minimum and maximum values of the red, green, and blue values associated with color P; or may be any other suitable value determined based on the red, green, and blue values associated with color P in RGB input color space 162.

Upon determining the RGBW values that will render color P in the RGBW output color space, display control circuitry 30 may provide data signals corresponding to the RGBW values to a display pixel on display 14 so that the color P is displayed by that display pixel (e.g., may provide a data signal corresponding to the red value R' to a red subpixel, a data signal corresponding to the green value G' to a green subpixel, a data signal corresponding to the blue value B' to a blue subpixel, and a data signal corresponding to the white value W' to a white subpixel in a display pixel).

Figure 10:
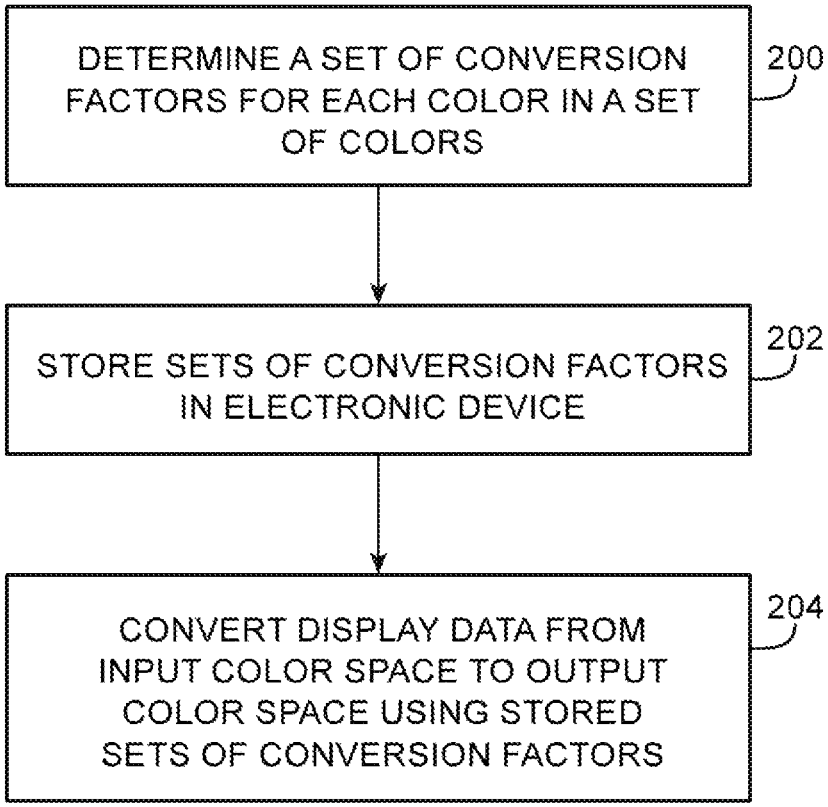
FIG. 10 is a flow chart of illustrative steps involved in configuring an electronic device to efficiently convert display data from an input color space to an output color space in accordance with an embodiment of the present invention.

A flow chart of illustrative steps involved in configuring an electronic device to efficiently convert display data from an input color space to an output color space is shown in FIG. 10.

At step 200, a set of conversion factors may be calculated for each color 164 in a set of colors in an input color space such as RGB color space 162. For example, during manufacturing of electronic device 10, computing equipment may be used to determine the RGBW values (R', G', B', and W') that will render each RGB color 164 (FIG. 9) in an RGBW output color space. Then, using equations (1), the computing equipment may determine a set of conversion factors (fR, fG, fB, and fW) for each color 164. Each set of conversion factors may be used to map the RGB values (R, G, and B) associated with a given color 164 in RGB color space 162 to RGBW values (R', G', B', and W') associated with the same color 164 in the RGBW color space. Sets of conversion factors may be calculated for any suitable number of colors 164 in RGB color space 162.

At step 202, the sets of conversion factors may be stored in electronic device 10 (e.g., in storage and processing circuitry 122, in display control circuitry 30, or in any other suitable location in device 10).

At step 204, display control circuitry 30 may use the stored sets of conversion factors to convert display data from an input color space (e.g., an RGB input color space) to an output color space (e.g., an RGBW output color space). Display control circuitry 30 may perform RGB-to-RGBW conversion on-the-fly without requiring conversion to an intermediary, device-independent color space.

Figure 11:
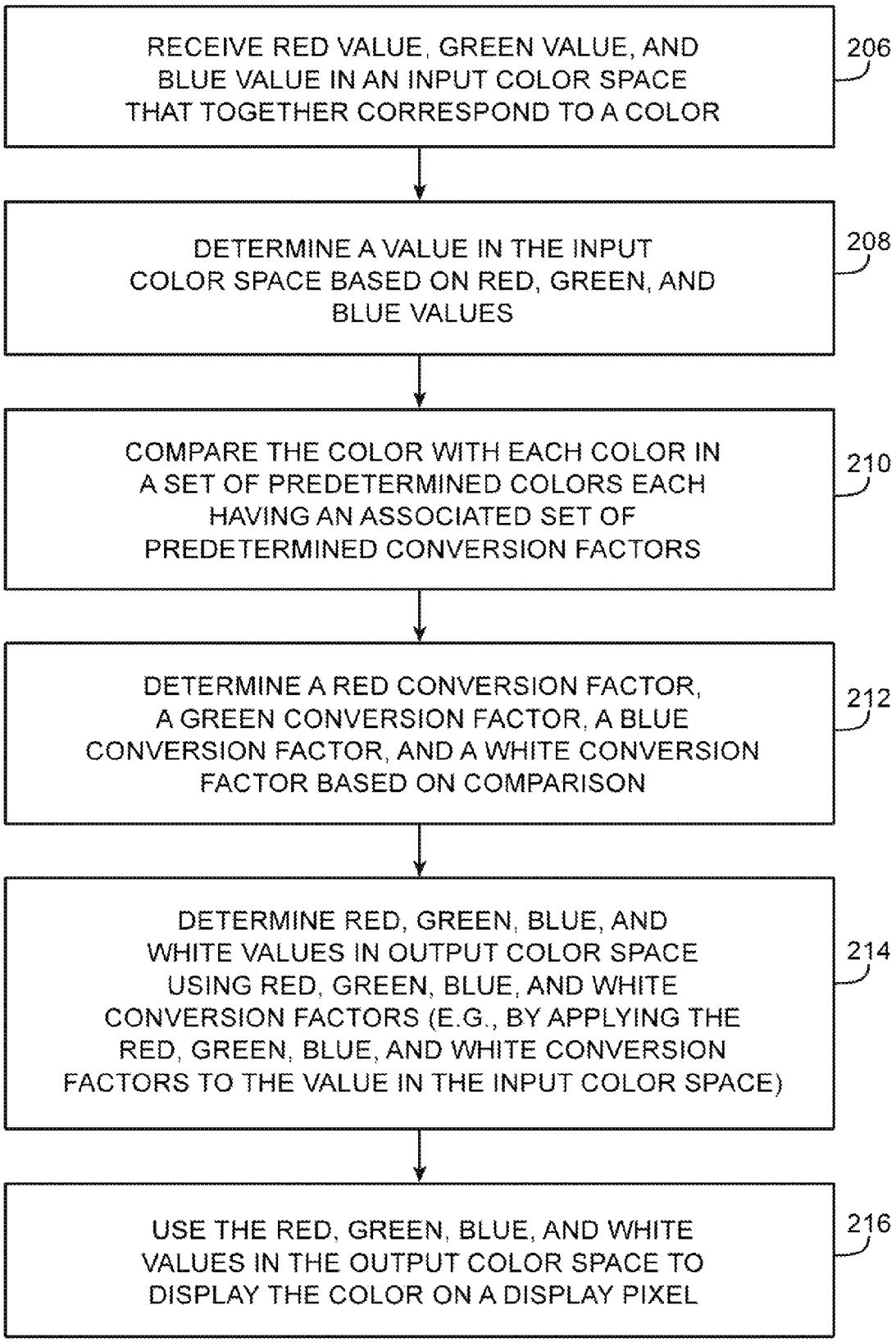
FIG. 11 is a flow chart of illustrative steps involved in converting display data from an input color space to an output color space using predetermined conversion factors in accordance with an embodiment of the present invention.

A flow chart of illustrative steps involved in efficiently converting display data from an input color space to an output color space (as described in step 204 of FIG. 10) is shown in FIG. 11.

At step 206, display control circuitry 30 may receive a red value R, a green value G, and a blue value B in an input color space (e.g., an input RGB color space) that together correspond to a color (e.g., color P of FIG. 9) to be displayed by a given display pixel 52.

At step 208, display control circuitry 30 may determine a value val(RGB) based on the red, green, and blue values in the input color space. The value determined during step 208 may be the minimum value of the red, green, and blue values; may be the maximum value of the red, green, and blue values; may be a fraction of the maximum value of the red, green, and blue values; or may be any other suitable value determined based on the red, green, and blue values in the input color space.

At step 210, display control circuitry 30 may compare the color P with the colors 164 for which predetermined conversion factors have been stored.

At step 212, display control circuitry 30 may determine a red conversion factor fR', a green conversion factor fG', a blue conversion factor fB', and a white conversion factor fW' based on the comparison of step 210. For example, if it is determined during step 210 that color P matches one of the colors 164 for which conversion factors have been stored, the conversion factors stored for that color may be used. If the color P does not exactly match any of the colors 164 for which conversion factors have been stored, then a set of conversion factors may be interpolated based on the stored conversion factors (e.g., using inverse distance weighting, Delaunay triangulation, bilinear interpolation, tetrahedral interpolation, other suitable interpolation techniques, a combination of these interpolation techniques, etc.).

At step 214, display control circuitry 30 may use the conversion factors (fR', fG', fB', and fW') for color P to determine a red value R', a green value G', a blue value B', and a white value W' that together correspond to the color in the output color space. This may include, for example, using equations (2) to apply each of the red, green, blue, and white conversion factors to the value val(RGB) in the input color space and to thereby obtain respective red, green, blue, and white values R', G', B', and W'.

At step 216, display control circuitry 30 (e.g., timing controller 126) may provide the RGBW values R', G', B', and W' to display 14 using paths 128 (FIG. 5). The red, green, blue, and white subpixels 52 in a display pixel may each receive an analog signal corresponding to a respective one of the RGBW values and may, as a result, display the intended color (e.g., color P) on display 14.

For simplicity, FIG. 11 describes the RGB-to-RGBW conversion process for a single pixel in display 14. It should be appreciated, however, that the RGB-to-RGBW conversion process described in FIG. 11 may be used for each pixel in pixel array 92.

If desired, the RGB-to-RGBW conversion process described in FIG. 11 may be performed in RGB linear space. For example, prior to converting the RGB values to RGBW values, the RGB values may be linearized to remove display gamma non-linearity (e.g., if the display gamma is not equal to one). If desired, alpha blending or other application-specific transformations may be performed in the RGB linear space prior to converting the display data to the RGBW color space. After the display data has been converted from RGB linear space to RGBW linear space, device-specific transformations such as color non-uniformity compensation transformations may be performed in the RGBW linear space (if desired). The RGBW values may then be de-linearized (e.g., to restore the non-linear display gamma).

The foregoing is merely illustrative of the principles of this invention and various modifications can be made by those skilled in the art without departing from the scope and spirit of the invention. The foregoing embodiments may be implemented individually or in any combination.

What is claimed is:

1. A method for displaying a color on a display pixel in a display having an array of display pixels, wherein the display is controlled using display control circuitry, the method comprising:

with the display control circuitry, receiving a red value, a green value, and a blue value in an RGB color space that together correspond to the color in the RGB color space;

with the display control circuitry, comparing the color in the RGB color space with each color in a plurality of predetermined colors in the RGB color space, wherein each predetermined color is associated with a set of predetermined conversion values; and with the display control circuitry, using the sets of predetermined conversion values to map the red value, the green value, and the blue value to values in an RGBW color space without converting to a device-independent color space so that the display pixel displays the color, wherein using the sets of predetermined conversion values to map the red value, the green value, and the blue value to values in the RGBW color space comprises multiplying each predetermined conversion value with a value based on the red value, the green value, and the blue value.

2. The method defined in claim 1 further comprising:

with the display control circuitry, determining a red conversion value, a green conversion value, a blue conversion value, and a white conversion value based on the comparison.

3. The method defined in claim 2 wherein at least one of the red, green, and blue conversion values is zero.

4. The method defined in claim 1 wherein the value is selected from the group consisting of: a minimum value of the red, green, and blue values; a maximum value of the red, green, and blue values; and a value between the minimum and maximum values of the red, green, and blue values.

5. The method defined in claim 1 wherein using the sets of predetermined conversion values to map the red value, the green value, and the blue value to the values in the RGBW color space comprises determining a red pixel value, a green pixel value, a blue pixel value, and a white pixel value that together correspond to the color in the RGBW color space.

6. The method defined in claim 5 wherein at least one of the red, green, and blue pixel values is zero.

7. The method defined in claim 5 wherein the display pixel comprises a red subpixel, a green subpixel, a blue subpixel, and a white subpixel, the method further comprising:

providing data signals corresponding to the red, green, blue, and white pixel values to the red, green, blue, and white subpixels so that the display pixel displays the color.

8. A method for displaying display data on an array of display pixels in a display comprising:

with display control circuitry, converting display data including red, green, and blue values from an RGB color space to an RGBW color space using predetermined conversion values and without converting to a device-independent color space, wherein the predetermined conversion values are associated with a plurality of predetermined colors in the RGB color space, and wherein converting the display data from the RGB color space to the RGBW color space comprises multiplying each predetermined conversion value with a value based on the red, green, and blue values.

9. The method defined in claim 8 wherein converting the display data from the RGB color space to the RGBW color space comprises converting the red, green, and blue values values that correspond to a color in the RGB color space to red, green, blue, and white pixel values that correspond to the color in the RGBW color space.

10. The method defined in claim 9 further comprising:

with the display control circuitry, comparing the color in the RGB color space to each of the predetermined colors.

11. An electronic device, comprising:

a display having an array of display pixels, wherein the display is configured to display colors in an RGBW output color space;

storage and processing circuitry configured to generate display data for the display in an RGB input color space; and display control circuitry configured to convert the display data from the RGB input color space to the RGBW output color space using predetermined conversion values and without converting to a device-independent color space, wherein the display control circuitry converts the display data from the RGB input color space to the RGBW output color space by multiplying each of the predetermined conversion values with a value based on the red, green, and blue values;

wherein the predetermined conversion values are associated with a plurality of predetermined colors in the RGB input color space.

12. The electronic device defined in claim 11 wherein the display comprises an organic light-emitting diode display and wherein the array of display pixels comprises an array of red, green, blue, and white organic-light-emitting diode pixels.

13. The electronic device defined in claim 12 wherein each of the red, green, and blue organic light-emitting diode pixels comprises a white organic light-emitting diode emitter and a color filter element formed over the white organic light-emitting diode emitter.

14. The electronic device defined in claim 13 wherein each of the white organic light-emitting diode pixels comprises an unfiltered white organic light-emitting diode emitter.

* * * * *